United States Patent [19]

Kelly et al.

[11] 4,019,044

[45] Apr. 19, 1977

[54] LIGHTING FIXTURE WITH REMOVABLE ELECTRICAL COMPONENT MOUNTING ARRANGEMENT

[75] Inventors: James P. Kelly, Cudahy; Donald Wandler, South Milwaukee, both of Wis.

[73] Assignee: McGraw-Edison Company, Elgin, Ill.

[22] Filed: Oct. 10, 1975

[21] Appl. No.: 621,419

[52] U.S. Cl. ..... 240/25; 240/3; 240/41 R; 240/41.5; 240/41.55; 240/51.11 R; 240/DIG. 3

[51] Int. Cl.[2] ..... F21S 13/10; F21V 23/02

[58] Field of Search ..... 240/25, 41.5, 41.55, 240/51.11 R, 153, DIG. 3, 3, 41 R, 73

[56] References Cited

UNITED STATES PATENTS

| | | | |
|---|---|---|---|
| 3,185,835 | 5/1965 | Müller et al. | 240/51.11 R |
| 3,264,465 | 8/1966 | Rex | 240/25 |
| 3,342,986 | 9/1967 | Jablonski et al. | 240/25 |
| 3,349,239 | 10/1967 | Fahey, Jr. et al. | 240/25 |
| 3,358,133 | 12/1967 | Thoman et al. | 240/3 |
| 3,459,936 | 8/1969 | Miller | 240/73 |
| 3,463,917 | 8/1969 | Stockwell et al. | 240/3 |
| 3,524,051 | 8/1970 | Baldwin et al. | 240/25 |
| 3,578,963 | 5/1971 | De Vos | 240/3 |
| 3,604,921 | 9/1971 | Wood et al. | 240/25 |
| 3,928,758 | 12/1975 | Osteen et al. | 240/25 |

*Primary Examiner*—Russell E. Adams, Jr.
*Attorney, Agent, or Firm*—Jon Carl Gealow

[57] ABSTRACT

A lighting fixture for a luminaire, such as that for an outdoor floodlight, has all of the electrical components for the luminaire, including the lamp socket, mounted on a tray that is removable from the fixture. The lamp socket is affixed to the tray at a location such that it properly positions a lamp inserted therein with respect to an optical system. By using standardized trays with various different ballasts and other electrical component variations, the same floodlight housing may be utilized for a variety of lamp types and power ratings.

19 Claims, 3 Drawing Figures

LIGHTING FIXTURE WITH REMOVABLE ELECTRICAL COMPONENT MOUNTING ARRANGEMENT

BACKGROUND OF THE INVENTION

1. Field of the Invention

This invention relates generally to a lighting fixture in which all of the electrical components are mounted on a removable tray, and more specifically, this invention relates to a lighting fixture for an outdoor floodlight in which the lamp socket, ballast and all other electrical components are mounted on a tray which may be selectively inserted into and removed from an appropriate compartment in the floodlight fixture.

2. Description of the Prior Art

Pole-mounted outdoor floodlights conventionally have a compartment (lighting compartment) in which a lamp is located with an appropriate optical system, such as an arrangement of metallic reflectors. The electrical components involved in energization of the lamp are usually located in a separate compartment (energization compartment) adjacent to the lighting compartment in which the lamp is located. For example, the energization compartment containing the electrical components may be located beneath or behind the lighting compartment, or in an arm by which the lighting compartment is supported in a cantilever fashion. In all of these cases, the lamp socket is mounted in the lighting compartment, while the electrical components, such as ballast, fuses, lead wires, capacitor, etc. are mounted in the energizing compartment. As a consequence, electrical connections have to be provided between the electrical components in the energization compartment and the lamp socket in the lighting compartment. This means, of course, that during the assembly of the lighting fixture care must be taken in assuring that appropriate electrical connections between the compartments are realized. In addition, if it is necessary to make any repairs, replacements or adjustments in the field, the possibility of damage to the connection exists, as well as the necessity of ensuring that the connection has been re-established, if it was necessary to break it during the work on the fixture.

Another problem with prior art devices is that in order to change the type or power rating of a lamp, it is either necessary to have a completely new fixture or go through considerable work to replace the various items in a given fixture. In some prior art devices, the components have been mounted on a section which is pivotable for permitting ease of access and work on the electrical components. In other cases, sliding arrangements have been utilized to permit availability of electrical components, as well as removal and replacement of the tray on which they are located. However, in none of these cases is the electrical socket for the lamp mounted with the other electrical components. Accordingly, any replacement of the electrical components, or of the lamp socket, requires severing of the electrical connection between the electrical components and the lamp socket and subsequent re-establishment thereof. Therefore, modification of prior art light fixtures to permit the utilization of a different type of lamp, or a different power rating thereof, has presented numerous difficulties.

SUMMARY OF THE INVENTION

The present invention relates to a lighting fixture which permits the rapid replacement of all the electrical components if a defect occurs in the electrical system, or if it is desired to change the type of lamp or power rating thereof that is utilized in the fixture. This is accomplished by having all of the electrical components, including the lamp socket, mounted on a single removable tray.

An appropriate housing is provided for the lighting fixture of a luminaire, such as an outdoor floodlight. In such case, the housing would be a watertight assembly. The housing has a lighting compartment, in which the lamp is located, and an energization compartment, in which the electrical components involved in energization of the lamp are located. These two compartments would normally be separated, but in some instances there may be less of a distinction between compartments than in others, in terms of a discrete partition. Accordingly, it should be recognized that the term "compartment," as utilized herein, refers to a particular section or area which need not be completely isolated from the other sections or areas of the lighting fixture.

In the lighting compartment, there will normally be located an optical system, such as a reflector or an arrangement of reflectors, that gives the desired distribution of light from the lamp located in the lighting compartment. In the particular embodiment disclosed herein, the optical system includes a bottom plate that separates the lighting compartment from the energization compartment, which is located below the lighting compartment. An aperture is located in the bottom plate to permit the base of the lamp to be passed therethrough.

An electrical component mounting tray is arranged to be releasably secured in a given location in the energization compartment. This electrical component mounting tray is formed of a channel member which is generally U-shaped, with the bight of the "U" elongated with respect to the legs thereof. (Of course, this tray could also take any other appropriate shape, for example that of a "Z".) All of the electrical components for the lighting fixture are mounted on the inner side of the bight of the U-shaped channel member which constitutes the electrical component mounting tray, although the tray could be reversed so that the components are mounted on the outer side of the bight. In addition, a lamp supporting structure, such as a lamp socket, is affixed to the tray, so that when the tray is secured in place by appropriate fastening means, the socket is placed to receive the base of the lamp as it is passed through the aperture in the base plate of the optical system in the lighting compartment. When the lamp is located in the lamp socket, it is properly positioned to provide the desired light distribution and yield maximum efficiency. In addition to the light socket, the other electrical components on the tray will include the ballast, fuses, lead wire, and, when required, a starter. In addition, a plug that is connected to convey electrical power to the electrical components and the socket is mounted on the tray. This plug is adapted to engage a mating plug that is connected to a source of electrical power. Handles are located on the outer side of the bight of the U-shaped channel member, so that the tray may be easily handled when being inserted into or removed from the energization compartment.

A door is arranged to enclose both the lighting and energization compartments with a watertight seal. An upper transparent portion, such as a clear window or lens, is located adjacent the lighting compartment, while an opaque portion of the door is located at the bottom adjacent the energization compartment. As a single door covers both compartments, opening the door permits removal of the lamp from the lighting compartment. By loosening the fastening means, the electrical component mounting tray may than be removed from the energization compartment for replacement or servicing.

With this arrangement, various types of lamps, with differing power ratings, may be utilized in a single housing, by merely replacing the electrical component tray. Therefore, there is much greater flexibility in the use to which a particular floodlight may be put. Also, it permits a customer the option of changing the cyle or power capability of the lamp being utilized without having to purchase a completely new lighting fixture. Further, by having a spare electrical component mounting tray available, it is possible to quickly have a system needing repair back in operating condition. The actual repair of the electrical system may then be completed at the maintenance man's leisure, without prolonging the time during which the floodlight is inoperative. Further, the single plug connection for the entire electrical system means that the electrical component mounting tray and all of the electrical components, including the socket, can be removed in a minimum of time with a minimum of effort. This is especially advantageous when the lighting fixture is an outdoor floodlight and the work on the fixture must be undertaken during wet or cold weather. Hence, the electrical component mounting tray arrangement disclosed herein has many advantageous features in comparison with prior art devices.

These and other objects, advantages and features of this invention will hereinafter appear, and for purposes of illustration, but not of limitation, an exemplary embodiment of the subject invention is shown in the appended drawing.

DETAILED DESCRIPTION OF THE PREFERRED EMBODIMENT

Figure 1:
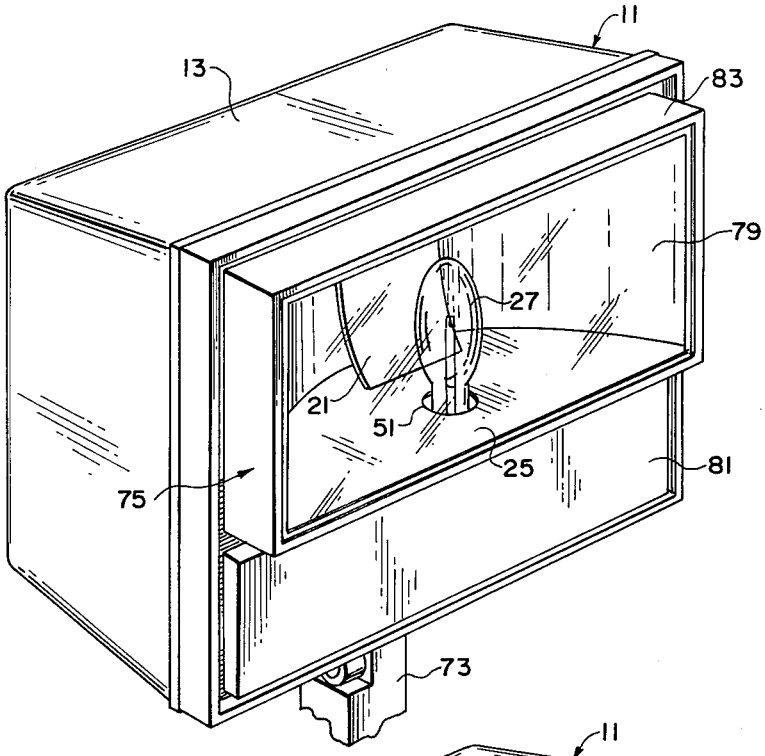
FIG. 1 is a left front perspective view of a lighting fixture incorporating the improved electrical component mounting arrangement of this invention.
Figure 2:
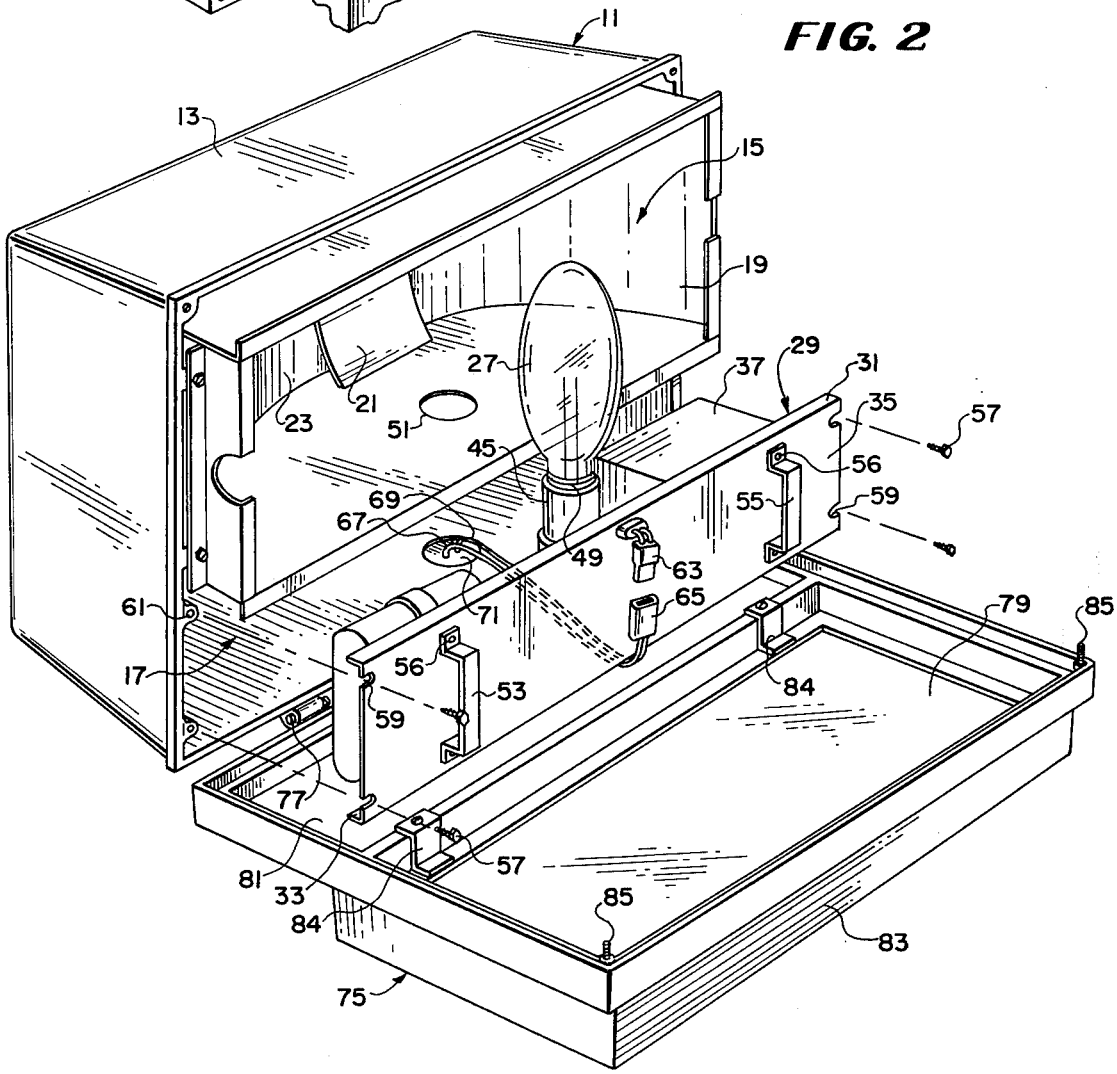
FIG. 2 is a left front perspective, partially exploded, view illustrating the lighting fixture and electrical component mounting tray of this invention.

With reference to FIGS. 1 and 2, a lighting fixture 11 is illustrated. Lighting fixture 11 may be a fixture for any type of appropriate luminaire, but in this preferred embodiment a luminaire of the pole-mounted outdoor floodlight type is depicted.

Lighting fixture 11 has a housing 13, which is cast of an appropriate material, such as aluminum. Housing 13 has two compartments 15 and 17. An appropriate optical assembly is located in compartment 15. While this optical assembly may take any desired form, the optical assembly of compartment 15 is constructed of the reflector portions 19, 21, 23, 25 and a top reflector, not shown. Reflector portions 19 and 23 are side panels on either side of the back panel 21, while the reflector portion 25 is a bottom plate, which also divides compartment 15 from compartment 17. While compartments 15 and 17 need not necessarily be separated, bottom plate 25 adds reflective capability to the optical assembly, while separating the two compartments. This particular optical assembly is discussed in more detail in the copending application of Donald Fieldstad, Jr. and Donald Wandler, entitled "Luminaire Optical System".

In view of the fact that compartment 15 contains the optical system for controlling distribution of the light, it has been termed the "lighting" compartment. Similarly, since the compartment 17 contains the electrical components involved in energization of a lamp 27 for the lighting fixture, it has been termed the "energization" compartment.

Lamp 27 is any suitable electrically energized lamp or bulb, but for the floodlight of the preferred embodiment it will normally be a high intensity discharge type of lamp.

Figure 3:
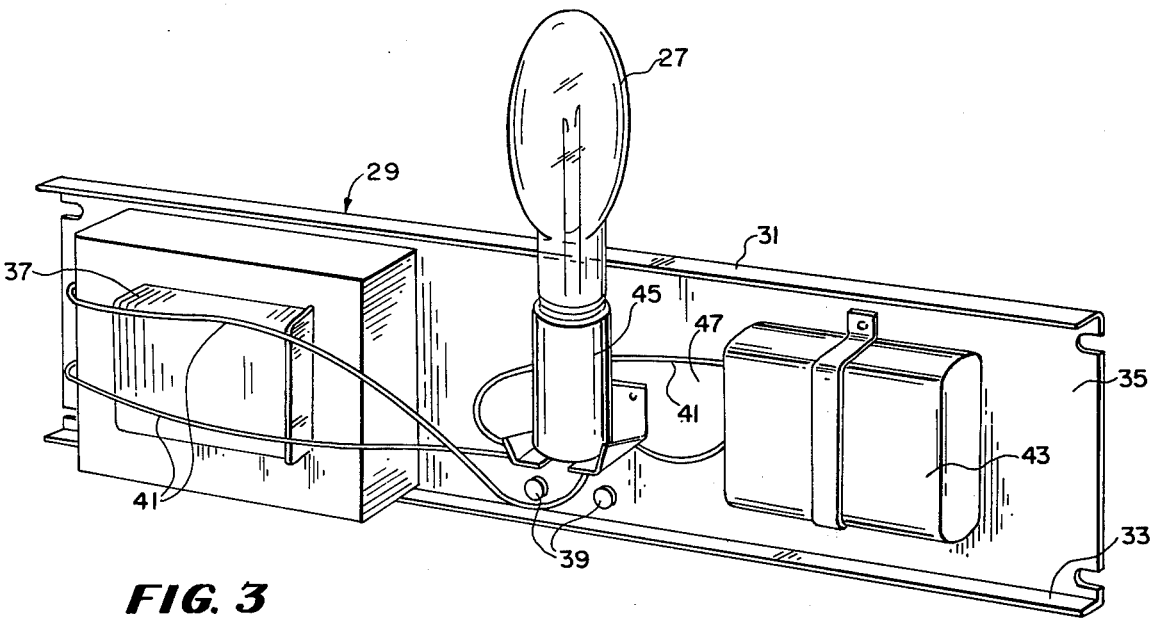
FIG. 3 is an elevational view of the electrical component mounting tray of this invention illustrating the electrical components mounted thereon.

An electrical component mounting tray 29 is illustrated in FIGS. 2 and 3. Tray 29 is formed of a generally U-shaped channel member having legs 31 and 33 and an elongated bight 35. All of the electrical components for the lighting fixture are mounted on the inner surface of the bight 35. These electrical components include appropriate ballast, such an an autotransformer 37, fuses 39 (not shown connected), all of the electrical leads 41, a capacitor 43 and, where required, a starter (not shown). In addition, a socket 45 for lamp 27 is affixed to tray 29 by means of a mounting bracket 47.

The inclusion of the lamp 27 in FIG. 2 is merely for purposes of illustration, as this lamp would have to be removed in order to insert the electrical component mounting tray 29 into the energization compartment 17. After insertion of the electrical component mounting tray 29 into energization compartment 17, the base 49 of lamp 27 would be passed through aperture 51 in bottom plate 25, so that the base 49 may be inserted into the socket 45. Socket 45 may be any type of lamp supporting structure, but in this preferred embodiment it is a threaded socket into which the threaded base 49 of lamp 27 is rotated for engagement of the respective threads. The mounting of socket 45 on tray 29 is such as to permit the insertion of base 49 through aperture 51 and into socket 45, and when the lamp 27 is supported by socket 45 through aperture 51, it is properly positioned, as illustrated in FIG. 1, for maximum lighting efficiency.

On the outer surface of the bight of the U-shaped channel member of tray 29, there is located a pair of handles 53 and 55, in order to hold tray 29 when it is inserted into and removed from energization chamber 17. Handles 53 and 55 are made of any appropriate material and attached to the tray 29 in a conventional fashion, such as by rivets or bolts 56. These handles could be any other suitable arrangement, such as wire forms snapped in openings in the tray to be retained by spring force, the handles also being rotatable to collapse against the tray 29.

Fastening devices, such as thread forming screws 57, are passed through notches 59 in tray 29 to be seated in appropriate receptacles 61 on the housing 13. When the fastening screws 57 are passed through notches 59 and engaged with receptacles 61, electrical component mounting tray 29 is secured in a desired given location. This given location is such that the socket 45 is appropriately aligned with aperture 51 in the bottom plate 25. Upon removal of fastening screws 57, the electrical component tray 29, and hence all of the electrical components, including socket 45, of the lighting fixture may be removed from energization compartment 17 in housing 13.

An electrical connector to provide electrical power for the lamp 27 and the electrical components on tray 29 is provided by the quick disconnect plugs 63 and 65. Plug 63 is mounted on electrical component mounting tray 29 and is electrically connected to the electrical components and socket 45. Plug 63 is engageable with mating plug 65, which is connected to a source of electrical power by leads 67 and 69 through a gasket and filter arrangement 71 in the bottom of energization compartment 17. As the floodlight of the preferred embodiment disclosed herein is primarily for mounting upon a pole, as evidenced by the broken away portion of a fitter 73 for attachment to an appropriate pole or tenon, lines 67 and 69 would pass down through or along the pole to the source of electrical power. With the arrangement of the quick disconnect plug 63 and plug 65, the electrical connection of power to the electrical components on tray 29 may be quickly and easily broken for removal of the electrical component mounting tray 29 from energization cmpartment 17.

Compartments 15 and 17 are sealed with a watertight seal by a door 75, which encloses both the lighting compartment 15 and the energization compartment 17. Door 75 is mounted on housing 13 by a pair of appropriate hinges 77. Door 75 has a transparent portion, such as an appropriate lens 79, adjacent lighting compartment 15 and an opaque portion 81 adjacent energization compartment 17. The door 75 may be cast of an appropriate material, such as aluminum, and the opaque portion 81 may be integrally cast with the rest of door 75. The lens 79 is mounted in a frame 83, which extends beyond opaque portion 81 and which may also be cast of aluminum as an integral part of door 75. Lens 79 is maintained in frame 83 by clamps 84. The door 75 may be maintained in the closed or sealing position by an appropriate closure arrangement, such as captive screws 85, which are retained in door 75. Appropriate gaskets around door 75 and lens 79 provide the desired watertight seal.

When it is desired to prepare the floodlight incorporating lighting fixture 11 for operation, the electrical component mounting tray 29 may be inserted into energization compartment 17 and secured in place by the fastening screws 57. Lamp 27 may then be screwed into socket 45 through aperture 51 and the system prepared for application of electrical power by engagement of mating plugs 63 and 65. Similarly, when it is desired to remove the mounting tray 29, the plugs 63 and 65 may be disconnected, lamp 27 unscrewed from socket 45 and the fastening screws 57 removed. The entire electrical system for the lighting fixture may then be removed from energization compartment 17 of housing 13 and replaced by a new mounting tray 29 and a new lamp 27, if required or desired. Hence, the housing 13 is provided with a greater versatility and adaptability than any lighting fixture heretofore known.

It should be understood that various modifications, changes and variations may be made in the arrangements, operations and details of constructions of the elements disclosed herein without departing from the spirit and scope of this invention.

We claim:

1. A lighting fixture comprising:

a housing having an energization compartment therein;

electrical component mounting means on which electrical components for controlling energization of a lamp are mounted, said electrical component mounting means adapted to be removably inserted into said energization compartment;

lamp supporting means affixed to said electrical component mounting means to hold the lamp and convey electrical power thereto; and electrical connector means for selectively conveying electrical power to said electrical components and said lamp supporting means.

2. A lighting fixture as claimed in claim 1 wherein:

said electrical component mounting means comprises a tray that is releasably secured in a given location in said energization compartment;

said lamp supporting means comprises a lamp socket that properly positions the lamp when said tray is secured in said energization compartment; and said electrical connector means comprises a plug mounted on said tray for engagement with a mating plug connected to a source of electrical power.

3. A lighting fixture comprising:

a housing having a lighting compartment and an energization compartment;

electrical component mounting means on which electrical components for the lighting fixture are mounted, said electrical component mounting means adapted to be removably inserted into said energization compartment;

lamp supporting means affixed to said electrical component mounting means, said lamp supporting means being adapted to position a lamp in said lighting compartment and convey electrical power thereto; and electrical connector means for selectively conveying electrical power to said electrical components and said lamp supporting means.

4. A lighting fixture as claimed in claim 3 wherein:

said lamp supporting means comprises a lamp socket;

said energization compartment is below said lighting compartment; and the base of the lamp is inserted into said lamp socket through an aperture in a divider between said lighting compartment and said energization compartment.

5. A lighting fixture as claimed in claim 3 wherein said electrical component mounting means comprises a generally U-shaped tray, with the bight of the "U" being elongated with respect to the legs thereof, said electrical components and said lamp supporting means being mounted on one side of the bight portion of said tray.

6. A lighting fixture as claimed in claim 5 and further comprising:

handles attached to the other side of the bight portion of said U-shaped tray to permit said tray to be inserted into, and removed from, said energization compartment; and fastening means to releasably secure said tray in a given location in said energization compartment.

7. A lighting fixture as claimed in claim 3 wherein all electrical components for energizing the lamp are mounted on said electrical component mounting means.

8. A lighting fixture as claimed in claim 7 wherein said electrical components include:

ballast;

fuses; and lead wires.

9. A lighting fixture as claimed in claim 8 wherein said electrical components further include a capacitor.

10. A lighting fixture as claimed in claim 3 and further comprising a door enclosing said compartment, a transparent portion of said door adjacent said lighting compartment and an opaque portion of said door adjacent said energization compartment.

11. A lighting fixture as claimed in claim 3 wherein said electrical connector means comprises a plug mounted on said electrical component mounting means for engagement with a mating plug connected to a source of electrical power.

12. A lighting fixture as claimed in claim 3 and further comprising light reflecting means in said lighting compartment.

13. A lighting fixture comprising:

a housing having a lighting compartment and an energization compartment;

an electrical component tray on which all electrical components of the lighting fixture are mounted;

fastening means to releasably secure said electrical component tray in a given location in said energization compartment;

a lamp socket affixed to said electrical component tray to support a lamp, said socket adapted to convey electrical power to the lamp and to position the lamp in said lighting compartment to gain maximum efficiency thereof;

a plug mounted on said electrical component tray and electrically connected to said electrical components and said lamp socket, said plug adapted to engage a mating plug connected to a source of electrical power to permit energization of the lamp; and a door enclosing said compartment, a transparent portion of said door adjacent said lighting compartment and an opaque portion of said door adjacent said energization chamber.

14. A lighting fixture as claimed in claim 13 wherein:

said energization compartment is below said lighting compartment; and the base of the lamp is inserted into said lamp socket through an aperture in a divider between said lighting compartment and said energization compartment.

15. A lighting fixture as claimed in claim 13 wherein said electrical component mounting tray comprises:

a generally U-shaped channel member, with the bight of the "U" being elongated with respect to the legs thereof, said electrical components and said lamp socket being mounted on one side of the bight of said channel member; and handles attached to the other side of the bight of said channel member to permit said tray to be inserted into, and removed from, said energization compartment.

16. A lighting fixture for an outdoor floodlight comprising:

a waterproof housing having a lighting compartment and an energization compartment, said lighting compartment being stationed over said energization compartment;

an optical system formed in said lighting compartment to provide the desired distribution of light from a lamp located in said lighting compartment, said optical system including a bottom plate;

a generally U-shaped electrical component mounting tray having the bight of the "U" elongated with respect to the legs thereof, the ballast and all other electrical components for the floodlight being mounted on the inner side of the bight of said tray;

handles attached to the outer side of the bight of said tray to permit said tray to be inserted into, and removed from, said energization compartment;

fastening means to releasably secure said electrical component mounting tray in a given location in said energization compartment;

a lamp socket affixed to said electrical component mounting tray to support the lamp, said socket adapted to convey electrical power to the lamp;

an aperture formed in said bottom plate of said optical system, securing of said electrical component mounting tray by said fastening means permitting the base of the lamp to be passed through said aperture and into said socket, so that the lamp is positioned for maximum lighting efficiency;

a plug mounted on said electrical component mounting tray and adapted to convey all of the electrical power required by said electrical components and the lamp, said plug being formed to engage a mating plug connected to a source of electrical power to permit energization of the lamp; and a door to enclose said compartments with a watertight seal, a lens portion of said door adjacent said lighting compartment and an opaque portion of said door adjacent said energization compartment.

17. An electrical component mounting arrangement for a lighting fixture comprising:

a tray to fit into an energization compartment of the lighting fixture;

electrical components for the lighting fixture mounted on said tray;

lamp supporting means mounted on said tray; and a plug to convey electrical power to said electrical components and said lamp supporting means, said plug being mounted on said tray for engagement with a mating plug connected to a source of electrical power.

18. An electrical component mounting arrangement as claimed in claim 17 wherein:

all of the electrical components of the lighting fixture are mounted on said tray; and said lamp supporting means is a lamp socket.

19. An electrical component mounting arrangement as claimed in claim 18 wherein said tray comprises:

a generally U-shaped channel member, with the bight of the "U" being elongated with respect to the legs thereof, said electrical components and said lamp socket being mounted on the inner side of the bight of said channel member; and handles attached to the outer side of the bight of said channel member to permit said tray to be inserted into, and removed from, the energization compartment of the lighting fixture.

* * * * *